United States Patent [19]

Ickes

[11] 3,962,839

[45] June 15, 1976

[54] STRUCTURAL WALL ELEMENT, ESPECIALLY LOAD BEARING WALL ELEMENT

[76] Inventor: Gustav Ickes, Karlsbader Str. 1a, 6462 Gelnhausen-Hailer, Germany

[22] Filed: July 24, 1974

[21] Appl. No.: 491,490

[30] Foreign Application Priority Data

July 28, 1973 Germany ..... 2338390

[52] U.S. Cl. ..... 52/262; 46/30; 52/271; 52/284; 52/593; 52/611

[51] Int. Cl.[2] ..... E04C 2/00; E04B 2/74

[58] Field of Search ..... 52/262, 79, 234, 250, 52/272, 668, 73, 595, 271, 284, 593, 594, 611; 46/20, 25, 30

[56] References Cited

UNITED STATES PATENTS

| | | | |
|---|---|---|---|
| 1,562,006 | 11/1925 | Sichterman | 46/25 |
| 2,069,391 | 2/1937 | Sample | 52/668 |
| 2,558,591 | 6/1951 | Starck | 46/20 |
| 3,066,436 | 12/1962 | Schuh | 46/30 |
| 3,367,074 | 2/1968 | Vanich | 52/73 |
| 3,530,626 | 9/1970 | Mezes | 52/262 |
| 3,566,558 | 3/1971 | Fisher | 52/595 |
| 3,805,467 | 4/1974 | McCrillis et al. | 52/79 |

FOREIGN PATENTS OR APPLICATIONS

| | | | |
|---|---|---|---|
| 49,313 | 9/1940 | Netherlands | 46/30 |
| 569,161 | 6/1944 | United Kingdom | 52/234 |

*Primary Examiner*—Ernest R. Purser
*Assistant Examiner*—James L. Ridgill, Jr.
*Attorney, Agent, or Firm*—W. G. Fasse; W. W. Roberts

[57] ABSTRACT

A load bearing wall element is provided with recesses or projections at the upper ends of the side edges, for interlocking or engaging projections or recesses respectively of adjacent wall elements. The wall elements may be provided with cantilevers extending at the tops of the side edges, the cantilevers either having recesses at their upper or lower edges in order to enable interlocking with recesses of adjoining elements. The wall elements may be fabricated from reinforced concrete and may preferably have a hard foam layer affixed thereto or incorporated therein.

1 Claim, 11 Drawing Figures

STRUCTURAL WALL ELEMENT, ESPECIALLY LOAD BEARING WALL ELEMENT

BACKGROUND OF THE INVENTION

This invention relates to structural wall elements, especially prefabricated elements. More particularly the invention relates to improved load bearing wall elements, for use in the erection of prefabricated buildings.

Prior art wall elements suitable for prefabrication require additional means to maintain the elements in their desired position, for example, means of a load bearing truss or framework, or by other connection elements.

Such prior art wall elements may have a sufficient stability of their own to use them in light construction. By using additional connection means these prior art elements may be assembled to form a statically stable system for supporting sufficient loads. Such wall elements have the advantage that they can be readily assembled. In most cases these known wall elements are interchangeable and individual wall sections are replaceable by other similar sections, for example, where other types of apertures are desired for walls or windows, and/or where different sanitary and/or electrical installations are desired. Thus, a building may be modified after its construction to later accommodate such features in accordance with standardized features.

Such prefabricated structures of prior art elements have the disadvantage, however, that they have a relatively low strength and no interlocking features. Hence, these structures may be employed only for single story, or at the most for two story buildings.

Prefabricated construction systems have been developed in the Soviet Union for overcoming the above disadvantages of prior art systems, wherein interengaging connections between individual elements are provided by tongue and groove joints. The manufacture of these tongue and groove elements, however, requires the use of special concrete as well as great accuracy in the shaping of the tongues and grooves to assure proper interlocking engagement. Thus, extensive manufacturing plant systems as well as construction equipment are required in connection with building elements of this type.

OBJECTS OF THE INVENTION

In view of the above, it is the aim of the invention to achieve the following objects singly or in combination:

to overcome or at least reduce the drawbacks of the prior art by providing a prefabricated wall element which represents a compromise between the heavy concrete construction techniques employed in the past and the conventional prefabrication systems;

to provide a wall element and a structure employing such a wall element, wherein the elements have a high strength and a safe interlocking stability even under high loads to form buildings having more than two stories; and to provide a wall element that can be easily assembled with other wall elements to form a structure, whereby the interlocking means are to be of simple construction and of simple configuration so as to avoid the need for expensive manufacturing equipment as well as to permit the interconnection with a minimum of assembly work.

SUMMARY OF THE INVENTION:

In accordance with the invention, the above objects are achieved by providing a wall element, especially a load bearing wall element having overlapping or mating vertically directed recesses and/or projections at the upper ends of their side edges, and adapted to engage similar projections and/or recesses on adjacent wall elements to provide a structure that can be readily assembled and disassembled with respect to correspondingly designed wall elements.

The essential feature of the wall elements according to the invention resides in the plug-in type of connection between adjacent elements, so that it is possible to produce a closed ring system for any type of floor plan. The ceilings for each story of a building constructed in accordance with the invention may be placed on top of the prefabricated standard wall elements in the form of standardized panels without interconnection to an additional ring beam for holding the structure together.

Wall elements especially adapted for use at the outside of a structure are preferably provided with cantilevers or short arms extending from the tops of the side edges of the elements for abutting interconnection with adjacent elements. The tops of the cantilevers or short arms are level with the tops of the wall elements. The cantilevers or short arms may be provided with recesses at their upper or lower edges, depending upon the position of the wall element in the structure, so that a wall element having a cantilever with a recess at its upper edge may be interlocked with a wall element having a cantilever with a recess at its lower edge. The cantilevers on the wall elements secure the plug-in connections of the individual joints or abutting connections and the cantilevers may be employed as a support for an enlarged ceiling or cover which may be used as a bypass or a balcony.

In other types of wall elements, projections may be provided having widths equal to one half the thickness of a wall element, or to a full thickness of a wall element. Further, elements may be provided with recesses having widths equal to one half a wall element or to a full wall element, so that combinations of the wall elements in accordance with the invention may be employed to fabricate the external and internal walls of a structure according to any desired floor plan.

BRIEF FIGURE DESCRIPTION

In order that the invention will be more clearly understood, it will now be described, by way of example, with reference to the accompanying drawings, wherein:

FIG. 1 is a simplified side view of the upper portion of a wall element, in accordance with one embodiment of the invention having two cantilevers;

FIG. 1*a* is a simplified illustration of a modification of the wall element of FIG. 1 employing only a single cantilever;

FIG. 2 is a simplified illustration of the side of a wall element adapted to cooperatively engage the wall element of FIG. 1, in accordance with the invention;

FIG. 2*a* is a simplified illustration of a modification of the wall element of FIG. 2 employing only a single cantilever, in accordance with the invention;

FIGS. 3 to 5 are simplified illustrations of the upper portions of wall elements in accordance with the invention, these arrangements having projections at each end of the upper edges; in FIG. 3 one projection has a length equal to the thickness of the wall element and the other projection has a length equal to half the thickness of a wall element, in FIG. 4 each projection has a length equal to half the thickness of a wall element, and in FIG. 5 each projection has a length equal to the thickness of a wall element;

FIG. 6 to 8 illustrate the upper portions of wall elements in accordance with the invention, having recesses at the top edges; in FIG. 6 one recess has a depth equal to the thickness of a wall element and the other recess has a depth equal to one half the thickness of a wall element, in FIG. 7 each recess has a depth equal to one half the thickness of a wall element, and in FIG. 8 each recess has a depth equal to the thickness of a wall element; and FIG. 9 is a perspective illustration of a portion of a wall construction incorporating wall elements in accordance with the invention.

DETAILED DESCRIPTION OF EXAMPLE EMBODIMENTS:

Figure 1:
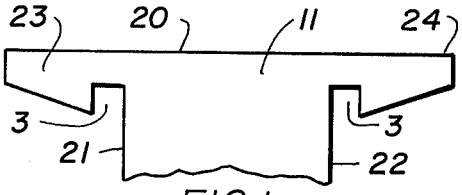

Referring now to the drawings, and more in particular to FIG. 1, therein is illustrated the side view of the upper portion of a wall element 11 in accordance with one embodiment of the invention. The wall element 11 has a continuous upper edge 20 and opposite side or vertical edges 21 and 22. The thicknesss of the wall element 11, as well as the thickness of the wall elements described with reference to the other figures, is substantially equal to the thickness of a wall in its constructional stage, taking into consideration, for example, strength requirements. For example, the wall elements or panels may be formed of reinforced concrete.

The wall element 11, as well as the wall elements to be subsequently described have heights equal to a unit of a building height, for example, the height of a story of a building, and widths selected to enable assemblying of the wall elements in the desired fashion or in accordance with standard floor plans.

The wall element 11 of FIG. 1 has cantilevers 23 and 24 extending from the edges 21 and 22. The cantilevers 23 and 24 form with their top edges the outer ends of said continuous upper edge 20. Each cantilever 23, 24 is provided with a downwardly facing recess 3 in its lower surface adjacent to the respective vertical edge 21, 22. The width (horizontal dimension) of the recesses 3 is for example, substantially equal to the thicknesses of the wall element. The height (vertical dimension) of the recesses 3 corresponds substantially to one half of the height of the respective cantilever at the edge of the adjacent side wall.

Figure 1A:
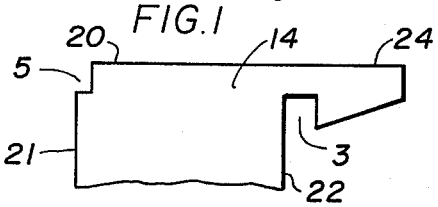

The wall element 14 of FIG. 1a is the same as the wall element 11 of FIG. 1 with the exception that the cantilever 23 is omitted and that instead a recess 5 is provided at the upper end of the edge 21. The recess 5 has a width equal to one half the thickness of a wall element, and a height equal to the height of the recess 3, and hence equal to the height of the portion of the cantilever 23 above the recess 3 in FIG. 1.

Figure 2:
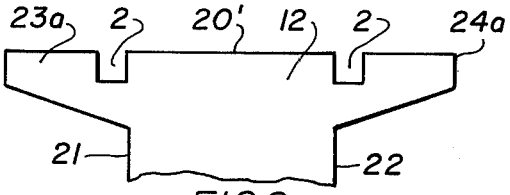

The wall element 12 of FIG. 2 is provided with cantilevers 23*a* and 24*a* as in the embodiment of FIG. 1, but in this case the cantilevers are provided with recesses 2 in their upper edges, i.e. adjacent edge 20'. The recesses 2 are aligned with the edges 21 and 22 of the wall element, and have a width equal to the thickness of a wall element and a height equal to the height of the recess 3 in the wall element of FIG. 1. It will thus be apparent that the wall element 11 of FIG. 1 and the wall element 12 of FIG. 2 may be joined together at right angles, with the recess 3 interlocked with the recess 2 to form a rigid joint in a structure.

Figure 2A:
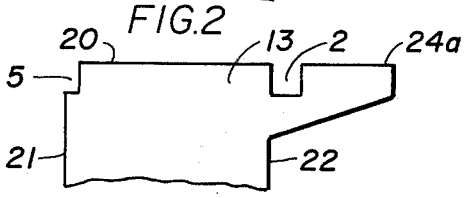

The wall element 13 of FIG. 2*a* differs from the wall element 12 of FIG. 2 only in the absence of the cantilever 23*a*, and in the provision of a recess 5 of the dimensions of the similar recess in the wall element of FIG. 1*a*.

Figure 3:
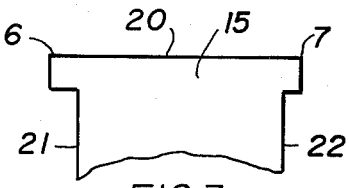
Figure 4:
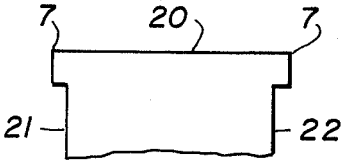
Figure 5:
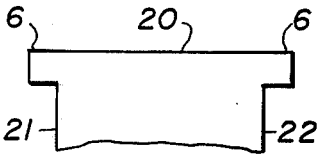

FIGS. 3 to 5 are side views of the upper portions of wall elements, in accordance with the invention, which are provided with projections from the side edges 21 and 22 adjacent their upper edge 20. Thus, in the wall element 15 of FIG. 3, one projection 6 has a width equal to the full thickness of a wall element, and the other projection 7 has a width equal to one half the thickness of a wall element. In the following disclosure, a projection 6 on a wall element of any form is understood to mean a projection having a width equal to a full wall thickness, and a projection 7 is understood to mean a projection having a width equal to one half a wall thickness. Thus, in the wall element of FIG. 4, two projections 7 are provided, and in the wall element of FIG. 5 two projections 6 are provided.

Figure 6:
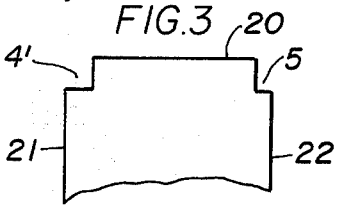
Figure 7:
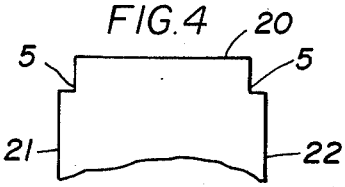
Figure 8:
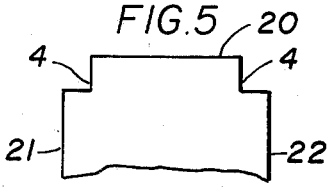

In the embodiments of the invention illustrated in FIGS. 6 to 8, the edges 21 and 22 of the wall units are provided with recesses instead of projections. The wall element of FIG. 6 is provided with one recess 4 having a width equal to the full thickness of a wall element, and a second recess 5 having a width equal to one half the thickness of a wall element. The arrangement of FIG. 7 is provided with two recesses 5 of widths equal to one half the wall thickness. The arrangement of FIG. 8 is provided with two recesses 4 having widths equal to the full thickness of a wall element.

Figure 9:
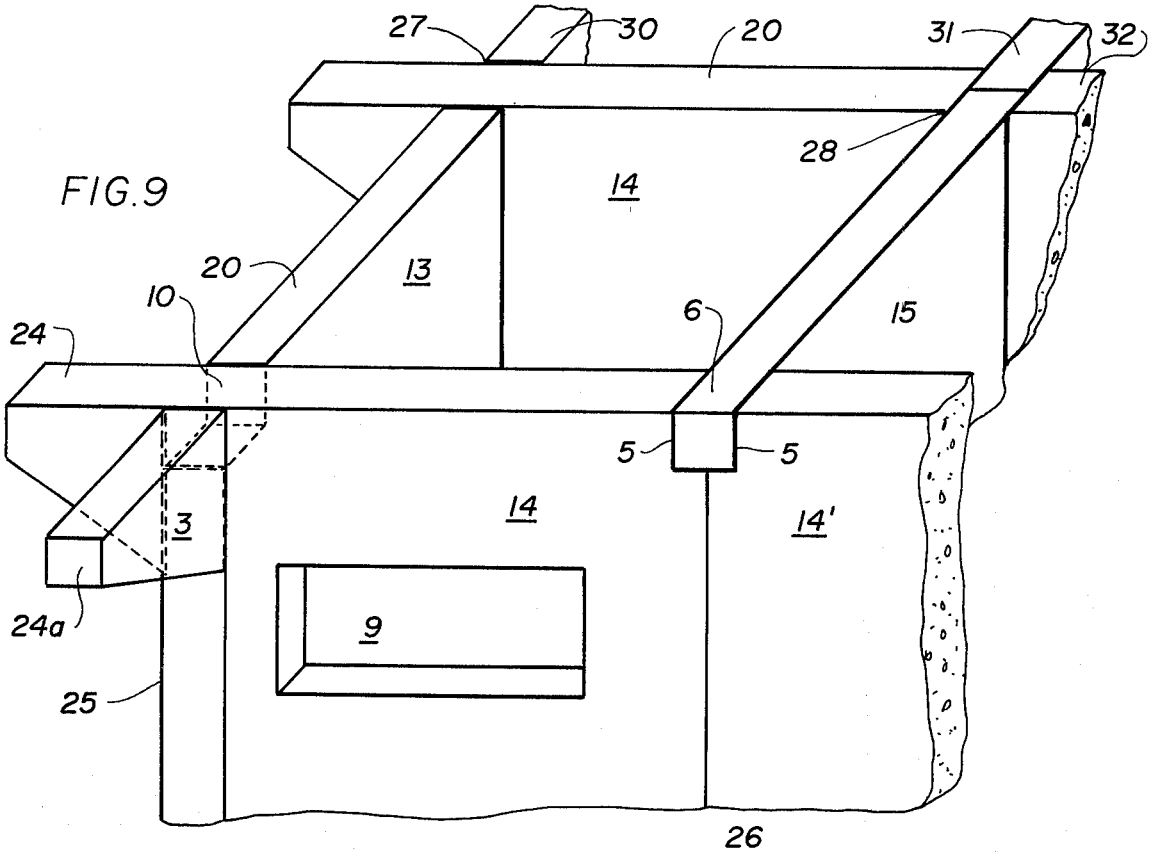

The wall elements illustrated in FIGS. 1 to 8 may be combined to fabricate a structure having any desired floor plan. An example of a structural combination of the various elements is illustrated in FIG. 9, wherein one corner 25 of the structure is formed of an element 14 of the type illustrated in FIG. 1*a*, and an element 13 of the type illustrated in FIG. 2*a*, the recess in the cantilevers of these elements being interlocked to form a joint 10 such that the upper edges 20 of the wall elements at the same level. The cantilevers 24 and 24*a* firmly hold the wall elements together, with the recesses 2 and 3 firmly hooked together to form a ring beam shaped union at the joint 10.

The upper edges of the cantilevers 24 and 24*a* are flush with the upper edges 20 of the respective wall elements. Thus, the combined top edges may serve as support for ceiling panels or the like. Further, the projections of the cantilevers 24 and 24*a* may serve as supports for balconies or bypasses in the structure.

As illustrated in FIG. 9, further wall elements may be joined to the wall elements forming the corner 25. For example, another element 14' of the type illustrated in FIG. 1*a* may be joined to the previously discussed element 14 of this type at a joint 26, with the recesses 5 thereof forming a combined recess having a width equal to the thickness of a wall element. Thus, a wall element 15 of the type illustrated in FIG. 3 may be assembled with its projection 6 interlocked in the combined recesses 5 at the joint 26.

Similarly, a further wall element 14 of the type illustrated in FIG. 1*a* may be joined to the element 13 at its other end, to form a joint 27. The wall element 15 in FIG. 9 thereby forms a further joint 28 with the last mentioned wall element 14. A further wall element 30, for example, for the type illustrated in FIGS. 1*a*, 6 or 7, may be provided at the joint 27. A wall element 31 of the type illustrated in FIGS. 3 or 4, may be provided at the joint 28 extending parallel to the wall element 15 at this joint, and the wall element 32, for example, of the type illustrated in FIG. 1a, FIG. 6, or FIG. 7 may be provided extending parallel to the wall 14 at this joint 28.

It is thus apparent that the wall elements above described may be combined in any desired manner to form a floor plan of a structure, the recesses and projections of the wall elements being designed to enable combining the wall elements in an interlocking structure with external and internal walls in a desired fashion.

As further illustrated in FIG. 9, one or more of the wall elements may be provided with an opening 9, for example, to serve as a window opening or a door opening.

The wall elements above described are load bearing elements, whereby the further floors or stories of a structure may be assembled on top of one another, to form a multi-story building. Since the elements are interlocking, in particular the elements employing the cantilevers, a ring beam shaped connection is provided for the structure, to firmly hold the elements in position.

The full width projections 6 and the full width recesses 4 are adapted to be employed at joints in a finished structure, for example, at an outside wall, where no further element parallel to the element carrying the projection 6 or recess 4 will extend beyond the joint in the same direction. Similarly, the half width projection 7 and recesses 5 are adapted to be provided at joints at which a further wall element will be provided parallel to the element carrying the respective projection 7 or recess 5. The interior and exterior walls of the structure may thereby be designed in the desired manner.

The wall elements as above disclosed, in accordance with the invention, are readily interconnected, so that a minimum of effort is involved in the fabrication of a structure. The wall elements further are capable of carrying high loads with a maximum of safety, due to the interconnection technique above disclosed, so that a building may be fabricated therefrom having a greater number of stories than was possible with prior art prefabricated wall elements.

In the structure of the invention illustrated in FIG. 9, it is apparent that the recess 2 of the element 13 lies inwardly of the side edge of the wall element, in order that the corner 25 of the structure be square.

Although the invention has been described with reference to specific example embodiments, it is to be understood, that it is intended to cover all modifications and equivalents within the scope of the appended claims.

I claim:

1. In a prefabricated building structure comprising four vertical load bearing wall elements, each having a top edge, a bottom edge, and two side edges, joints between adjacent wall elements, each wall element having a height substantially equal to the height of a story of said building structure, the improvement wherein each of said four wall elements comprises two cantilevers, each cantilever extending from a top corner and from the respective side edge in the plane of the respective wall element, each cantilever having an upper edge extending level with the top edge of the corresponding wall element to form a common top edge, and a lower edge extending above the bottom edge of the corresponding wall element, two of said wall elements having an upwardly opening recess in said common top edge adjacent to each cantilever positioned so that an edge of said upwardly opening recess registers with the respective side edge of the wall element, each of the remaining two wall elements having a downwardly opening recess in the lower edge of each of its cantilevers adjacent to the respective side edge thereof to which the respective cantilever is joined so that an edge of said downwardly opening recess registers with the adjacent side edge, said recesses having widths substantially equal to the widths of said wall elements and depths substantially equal to one half the height of said cantilevers at the respective side edges of said wall elements, said joints being formed by the interlocking between an upwardly opening recess and a downwardly opening recess, whereby two interlocking cantilevers extend from each corner of the structure to form a ring beam.

* * * * *